US008562450B2

(12) United States Patent
Gormley

(10) Patent No.: US 8,562,450 B2
(45) Date of Patent: Oct. 22, 2013

(54) RECOILING TETHERED GOLF BALL

(76) Inventor: Michael Gormley, Pittsburgh, PA (US)

( * ) Notice: Subject to any disclaimer, the term of this patent is extended or adjusted under 35 U.S.C. 154(b) by 151 days.

(21) Appl. No.: 13/066,899

(22) Filed: Apr. 27, 2011

(65) Prior Publication Data

US 2011/0281661 A1 Nov. 17, 2011

Related U.S. Application Data

(60) Provisional application No. 61/395,522, filed on May 17, 2010.

(51) Int. Cl.
*A63B 69/36* (2006.01)

(52) U.S. Cl.
USPC ..... 473/147; 473/146

(58) Field of Classification Search
USPC ..... 473/139, 142–147
See application file for complete search history.

(56) References Cited

U.S. PATENT DOCUMENTS 1,528,909 A * 3/1925 Bullard ..... 473/146
2,514,093 A * 7/1950 Royston ..... 473/147
3,051,491 A * 8/1962 Cabot ..... 473/147
3,521,887 A * 7/1970 Butkus ..... 473/147
4,014,553 A 3/1977 Sakamoto
4,092,027 A 5/1978 Carter
4,095,798 A * 6/1978 Marple ..... 473/147
4,125,230 A 11/1978 Fischer
4,240,629 A 12/1980 Song
4,272,076 A 6/1981 Song
4,429,880 A 2/1984 Chen
4,432,551 A 2/1984 Chen
4,496,156 A 1/1985 Centafanti
4,526,374 A 7/1985 Ban
4,609,197 A 9/1986 Vodin
4,655,460 A * 4/1987 Hambright ..... 473/143
4,660,835 A * 4/1987 Locurto ..... 473/147
4,662,639 A 5/1987 Bonotto
4,674,744 A 6/1987 Walsh
4,927,154 A * 5/1990 Boyer et al. ..... 473/142
4,944,513 A 7/1990 Zentner
4,964,634 A 10/1990 Boyer
4,986,551 A 1/1991 Langlois
4,989,877 A * 2/1991 Bias ..... 473/149
5,011,155 A 4/1991 Udomkesmalee
5,039,106 A 8/1991 Dugard
5,054,786 A 10/1991 Solomon
5,121,923 A 6/1992 D'Allura
5,156,400 A 10/1992 Nemeth
D349,937 S 8/1994 Hill
5,366,225 A 11/1994 Lazar
5,386,997 A 2/1995 Smith (Continued)

*Primary Examiner* — Nini Legesse
(74) *Attorney, Agent, or Firm* — Andrew W. Ludy

(57) ABSTRACT

A recoiling tethered golf ball has a first hole extending through the ball center and a second hole extending at right angles to the first hole. A nail in the second hole extends beyond the first hole into the golf ball. An anchor has an elongated shaft tapering to a point for insertion into the ground. The upper end is formed into an eye. The anchor has optional threads for attachment to a board or tree. A surgical tubing tether extends from a first end to a second end. The first end is received in the golf ball first hole and is looped around the nail. The tether second end is looped around the anchor eye. A first retaining clip encircles the first end loop. A second retaining clip encircles the second end loop to secure the loop from releasing.

15 Claims, 2 Drawing Sheets

(56) References Cited

U.S. PATENT DOCUMENTS

| | | | |
|---|---|---|---|
| 5,413,347 | A | 5/1995 | Prater |
| 5,544,886 | A | 8/1996 | Van Skiver |
| 5,662,527 | A | 9/1997 | Jacquinot |
| 5,688,195 | A | 11/1997 | Caso |
| 5,853,334 | A | 12/1998 | Winebrenner |
| 5,961,391 | A | 10/1999 | Priscella |
| 5,989,129 | A | 11/1999 | O'Neill |
| 5,989,137 | A | 11/1999 | Krueger |
| 6,343,996 | B1 | 2/2002 | Gasseling |
| 6,579,189 | B2 | 6/2003 | Anzaldua |
| 7,014,577 | B2 | 3/2006 | Van Asselt |

* cited by examiner

RECOILING TETHERED GOLF BALL

CROSS-REFERENCE TO RELATED APPLICATIONS

Reference is hereby made to provisional patent application titled, "Recoiling Tethered Golf Ball;" filed by Michael Gormley, of Pittsburgh, Pa., on May 17, 2010, Ser. No. 61/395,522. The prior application is expressly incorporated herein by reference.

STATEMENT REGARDING FEDERALLY SPONSORED RESEARCH OR DEVELOPMENT

Not Applicable

BACKGROUND OF THE INVENTION

This invention relates to the field of golf balls and more particularly to a golf ball that is tethered to an anchor.

In the course of practicing golf, it is necessary to hit many golf balls repeatedly over time to develop technique in the swing, grip, stance, etc. In order to avoid chasing the balls, some means of returning a ball is expedient. Allowing practice in a limited and private area such as a back yard would be convenient. Practicing on grass allows a realistic venue. The player can tee up or chip on actual grass on uneven ground, rather than the synthetic or sparse grass found on driving ranges. One can avoid range fees, as well as the traveling to and from the range. Using an actual golf ball instead of a plastic or rubber analogue gives a realistic feel and sound as if in a real game. A means for attaching the tether to the ball must preclude the possibility of damaging the face of an expensive driver. The tethering means must not release from the ball, unless the ball is destroyed.

Accordingly, there is a need to provide a recoiling tethered golf ball that can return the ball to near the starting point.

There is a further need to provide a recoiling tethered golf ball of the type described and that uses an actual golf ball.

There is a yet further need to provide a recoiling tethered golf ball of the type described and that will not damage the face of a driver.

There is a still further need to provide a recoiling tethered golf ball of the type described and that the tether will not release from the ball.

There is another need to provide a recoiling tethered golf ball of the type described and that can be manufactured cost-effectively in large quantities of high quality.

BRIEF SUMMARY OF THE INVENTION

In accordance with the present invention, there is provided a recoiling tethered golf ball 10. The genuine golf ball 12 has an outside surface 14 and a geometric ball center. The golf ball 12 has a first hole 16 extending radially through the ball center. The golf ball 12 has a second hole 18 extending at right angles to the first hole 16. A nail 34 in the golf ball second hole 18, extends beyond the first hole 16 into the golf ball 12.

An anchor 20, has an elongated shaft 22 tapering to a point 28 for insertion into the ground. The upper end 26 is formed into an eye 30. The anchor 20 has optional threads 32. The anchor 20 can be attached to a board or tree or the ground.

A surgical tubing tether 36 extends from a first end 38 to a second end 40. The first end is received in the golf ball first hole 16 and is looped around the nail 34. The tether second end is looped around the anchor eye 30.

A first retaining clip 46 encircles the first end loop 42. A second retaining clip 48 encircles the second end loop 44 to secure the loop 44 from releasing. The clips are simply bent around the tether and crimped tightly.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
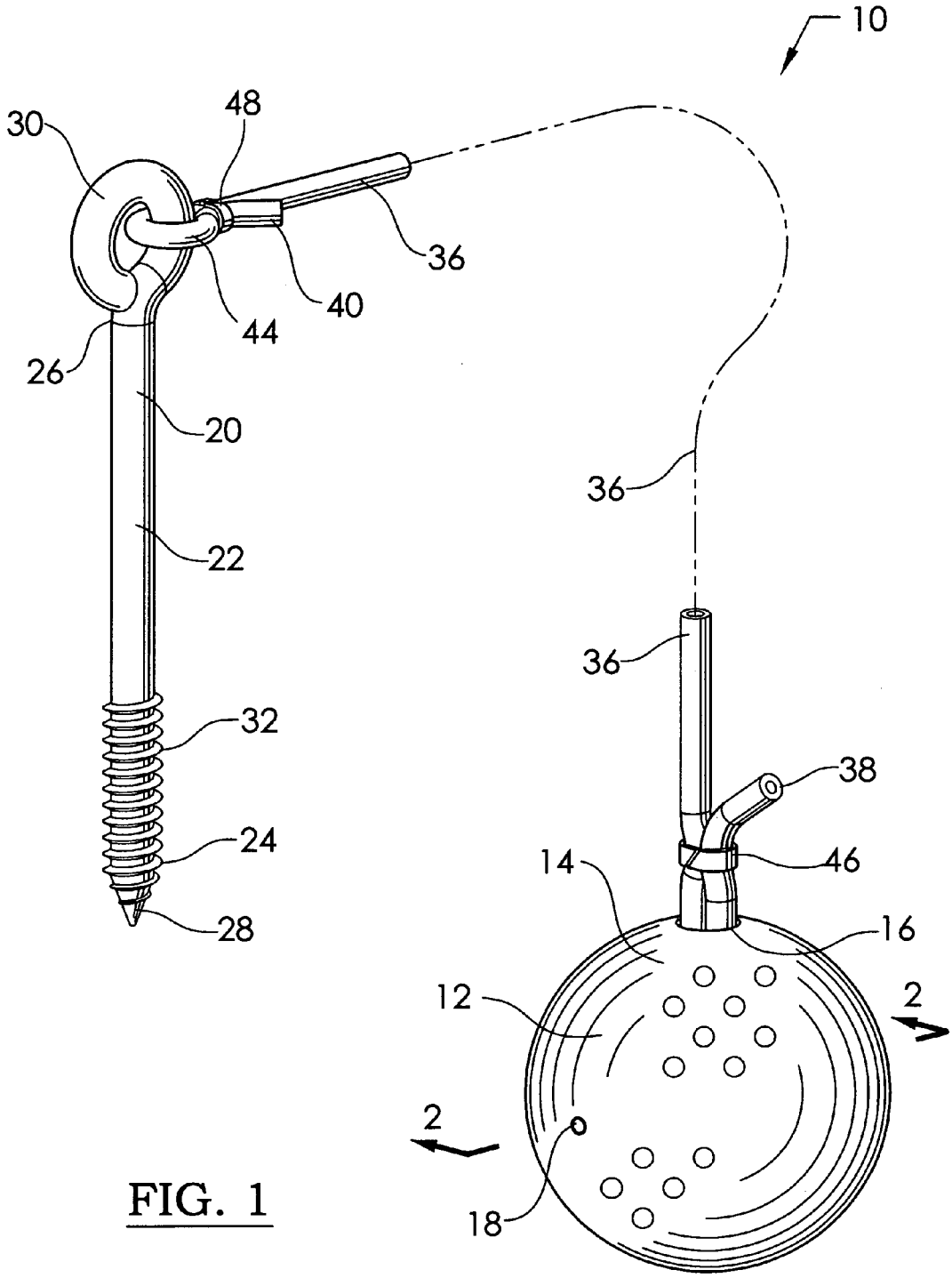
FIG. 1 is a perspective view of a recoiling tethered golf ball constructed in accordance with the invention.
Figure 2:
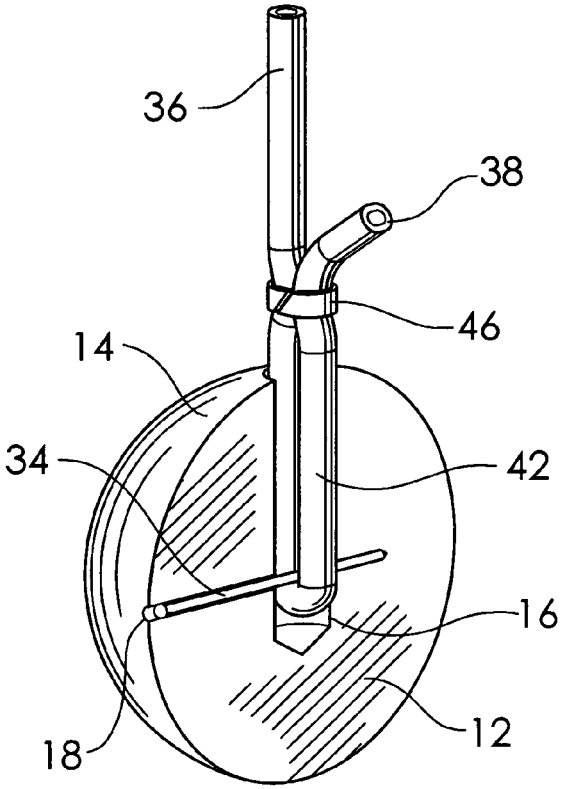
FIG. 2 is a partial, sectional perspective assembly view of a golf ball used in connection with the recoiling tethered golf ball of FIG. 1, taken along lines 2-2 of FIG. 1, and showing the internal construction.
Figure 2:
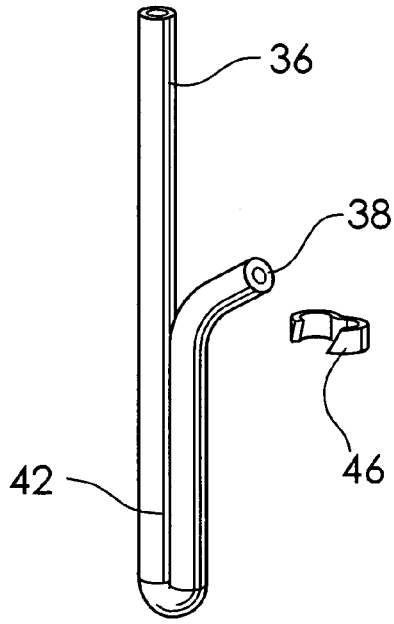
Figure 3:
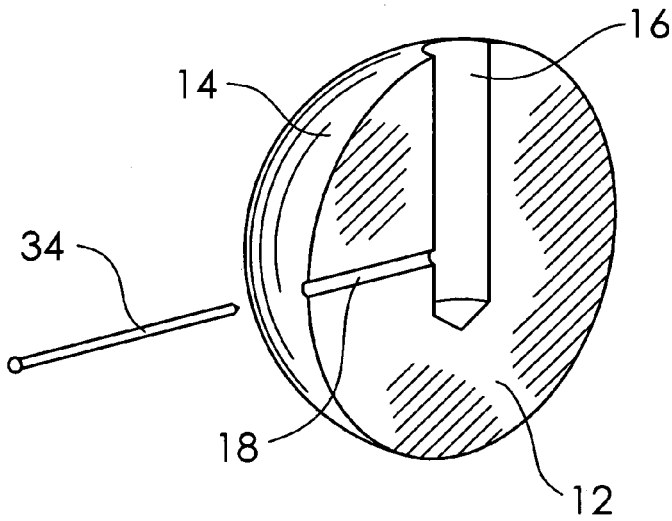
FIG. 3 is an exploded perspective assembly view of the golf ball of FIG. 2.

Referring now to the drawing, a recoiling tethered golf ball is shown at 10, and includes a golf ball 12. The golf ball 12 has an outside surface 14 and a geometric ball center. The golf ball 12 has a first hole 16 extending generally radially from the outside surface 14 through the ball center. The first hole 16 has a predetermined diameter, preferably about 5/16 inch diameter, drilled past the center to a depth of about 1 1/8 inches. The golf ball 12 has a second hole 18 extending generally radially from the outside surface 14 to the first hole 16. The second hole 18 is generally at right angles to the first hole 16. The second hole 18 has a second hole diameter smaller than the first hole predetermined diameter, specifically about 1/16 inch diameter.

An anchor 20 is provided, having an elongated shaft 22 extending from a lower end 24 to an upper end 26. The lower end 24 tapers to a point 28 for insertion into the ground (not shown). The upper end 26 is formed into an eye 30. The anchor 20 has optional threads 32 extending from the lower end 24 partway upward so as to resist withdrawal of the anchor 20. The anchor 20 is a common screw-eye, although any rigid, elongated shaft with an attachment point will serve. The threads 32 can be used to attach the anchor to a board or tree if that proves expedient.

A nail 34 is received in the golf ball second hole 18, and extends (is driven) beyond the first hole 16 into the golf ball 12 so as to resist withdrawal of the nail 34 from the golf ball 12. The nail 34 is preferably a 16 gauge wire brad 1 1/4 inches in length.

A tether 36 extends from a first end 38 to a second end 40. The tether 36 is made of an elastomeric material, preferably latex surgical tubing. The tubing outside diameter should be about 3/16 inch, the inside diameter about 1/8 inch. The tether 36 is formed into a loop 42 adjacent the first end 38. The first end loop 42 should be about 2 inches long. The first end loop 42 is received in the golf ball first hole 16 with the tether first end 38 passing downward into the first hole 16, around the nail 34, and upward out of the first hole 16. The assembly sequence is to push the first end loop 42 all the way into the first hole 16. The nail 34 is then inserted into the second hole 18, passing between the two portions of the first end loop 42 without piercing the tether material, and is then driven beyond the first hole 16, and further into the golf ball 12. The nail 34 is then countersunk below the outside surface 14, and the second hole 18 is filled with epoxy filler. The tether 36 is formed into a loop 44 adjacent the second end 40. The second end loop 44 is looped around the anchor eye 30.

Latex surgical tubing is the preferred material because it is light enough to allow the ball to fly normally, decelerates the ball smoothly, and returns the ball to near the starting point safely. The latex surgical tubing will stretch to two to four times its relaxed length in the present invention. The latex surgical tubing is capable of over 700% elongation at failure. Thus, a strong golf hitter will strain the material to only about 60% of its yield strength, providing a margin of safety. Adjusting the recoil is easily done by shortening the tether at the anchor.

A first retaining clip 46 encircles the first end loop 42 adjacent the outside surface 14 to secure the loop 42 from releasing. The first retaining clip 46 can be any easily bent and crimped material, such as round or rectangular wire, for example a hog ring. A second retaining clip 48 encircles the second end loop 44 to secure the loop 44 from releasing. The clips are simply bent around the tether and crimped tightly.

In use, the anchor 20 will be inserted into the ground, the golf ball 12 will be placed upon the ground at a starting point, the golf ball 12 will be struck and will fly away from the anchor 20, the tether 36 will stretch elastically, the flight of the ball will thereby be arrested, and the ball will return to adjacent the starting point, urged by the elastic bias of the tether.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

Recoiling Tethered Golf Ball

Part
No. Description
10 recoiling tethered golf ball
12 golf ball
14 golf ball outside surface
16 golf ball first hole
18 golf ball second hole
20 anchor
22 anchor elongated shaft
24 anchor lower end
26 anchor upper end
28 anchor point
30 anchor eye
32 anchor threads
34 nail
36 tether
38 first end
40 second end
42 first end loop
44 second end loop
46 first retaining clip
48 second retaining clip The embodiments of the invention in which an exclusive property or privilege is claimed are defined as follows:

1. A recoiling tethered golf ball comprising:

a golf ball having an outside surface and a geometric ball center, the golf ball having a first hole extending from the outside surface inward, the first hole having a predetermined diameter, the golf ball having a second hole extending from the outside surface to the first hole;

an anchor having an elongated shaft extending from a lower end to an upper end, the lower end being adapted for insertion into the ground;

an elongated element received in the golf ball second hole so as to resist withdrawal of the elongated element from the golf ball; and a tether extending from a first end to a second end, the tether being made of an elastomeric material, the tether first end being received in the golf ball first hole, the tether first end being attached to the golf ball by the elongated element, the tether second end being attached to the anchor upper end;

so that the anchor will be inserted into the ground, the golf ball will be placed upon the ground at a starting point, the golf ball will be struck and will fly away from the anchor, the tether will stretch elastically, the flight of the ball will thereby be arrested, and the ball will return to adjacent the starting point, urged by the elastic bias of the tether.

2. The recoiling tethered golf ball of claim 1, wherein the golf ball further comprises:

the first hole extending generally radially from the outside surface through the ball center;

the second hole being generally at right angles to the first hole; and the second hole having a second hole diameter smaller than the first hole predetermined diameter.

3. The recoiling tethered golf ball of claim 1, wherein the anchor further comprises:

the lower end tapering downward; and the upper end being formed into an eye.

4. The recoiling tethered golf ball of claim 3, wherein the anchor further comprises threads extending from the lower end partway upward so as to resist withdrawal of the anchor.

5. The recoiling tethered golf ball of claim 3, wherein the elongated element further comprises a nail received in the golf ball second hole and extending beyond the first hole into the golf ball so as to resist withdrawal of the nail from the golf ball.

6. The recoiling tethered golf ball of claim 5, wherein the tether further comprises:

the tether being formed into a loop adjacent the first end, the first end loop being received in the golf ball first hole with the tether first end loop passing around the nail; and the tether being formed into a loop adjacent the second end, the second end loop being looped through the anchor eye.

7. The recoiling tethered golf ball of claim 6, further comprising:

a first retaining clip encircling the first end loop to secure the loop from releasing; and a second retaining clip encircling the second end loop to secure the loop from releasing.

8. A recoiling tethered golf ball comprising:

a golf ball having an outside surface and a geometric ball center, the golf ball having a first hole extending generally radially from the outside surface toward the ball center, the first hole having a predetermined diameter, the golf ball having a second hole extending from the outside surface to the first hole;

an anchor having an elongated shaft extending from a lower end to an upper end, the lower end being adapted for insertion into the ground;

an elongated element received in the golf ball second hole and extending beyond the first hole into the golf ball so as to resist withdrawal of the elongated element from the golf ball;

a tether extending from a first end to a second end, the tether being made of an elastomeric material, the tether being formed into a loop adjacent the first end, the first end loop being received in the golf ball first hole with the tether first end passing around the elongated element, so that the first end loop is attached to the golf ball by the elongated element, the tether second end being attached to the anchor upper end; and a first retaining clip encircling the first end loop to secure the loop from releasing; so that the anchor will be inserted into the ground, the golf ball will be placed upon the ground at a starting point, the golf ball will be struck and will fly away from the anchor, the tether will stretch elastically, the flight of the ball will thereby be arrested, and the ball will return to adjacent the starting point, urged by the elastic bias of the tether.

9. The recoiling tethered golf ball of claim 8, wherein the golf ball further comprises:

the first hole extending generally radially from the outside surface through the ball center;

the second hole being generally at right angles to the first hole; and the second hole having a second hole diameter smaller than the first hole predetermined diameter.

10. The recoiling tethered golf ball of claim 8, wherein the anchor further comprises:

the lower end tapering downward; and the upper end being formed into an eye.

11. The recoiling tethered golf ball of claim 10, wherein the anchor further comprises threads extending from the lower end partway upward so as to resist withdrawal of the anchor.

12. The recoiling tethered golf ball of claim 10, wherein the elongated element further comprises a nail received in the golf ball second hole and extending beyond the first hole into the golf ball so as to resist withdrawal of the nail from the golf ball.

13. The recoiling tethered golf ball of claim 12, wherein the tether further comprises:

the tether being formed into a loop adjacent the first end, the first end loop being received in the golf ball first hole with the tether first end loop passing around the nail; and the tether being formed into a loop adjacent the second end, the second end loop being looped through the anchor eye.

14. The recoiling tethered golf ball of claim 13, further comprising:

a first retaining clip encircling the first end loop to secure the loop from releasing; and a second retaining clip encircling the second end loop to secure the loop from releasing.

15. A recoiling tethered golf ball comprising:

a golf ball having an outside surface and a geometric ball center, the golf ball having a first hole extending generally radially from the outside surface through the ball center, the first hole having a predetermined diameter, the golf ball having a second hole extending generally radially from the outside surface to the first hole, the second hole being generally at right angles to the first hole, the second hole having a second hole diameter smaller than the first hole predetermined diameter;

an anchor having an elongated shaft extending from a lower end to an upper end, the lower end tapering to a point for insertion into the ground, the upper end being formed into an eye, the anchor having threads extending from the lower end partway upward so as to resist withdrawal of the anchor;

a nail received in the golf ball second hole and extending beyond the first hole into the golf ball so as to resist withdrawal of the nail from the golf ball;

a tether extending from a first end to a second end, the tether being made of an elastomeric material, the tether being formed into a loop adjacent the first end, the first end loop being received in the golf ball first hole with the tether first end passing downward into the first hole, around the nail, and upward out of the first hole, so that the first end loop is attached to the golf ball by the nail, the tether being formed into a loop adjacent the second end, the second end loop being looped through the anchor eye;

a first retaining clip encircling the first end loop to secure the loop from releasing; and a second retaining clip encircling the second end loop to secure the loop from releasing; so that the anchor will be inserted into the ground, the golf ball will be placed upon the ground at a starting point, the golf ball will be struck and will fly away from the anchor, the tether will stretch elastically, the flight of the ball will thereby be arrested, and the ball will return to adjacent the starting point, urged by the elastic bias of the tether.

* * * * *